United States Patent [19]

Maag

[11] Patent Number: 4,822,038

[45] Date of Patent: Apr. 18, 1989

[54] CALF ISOLATING EXERCISE MACHINE

[76] Inventor: Henry Maag, 5332 Clark Cir., Westminster, Calif. 92683

[21] Appl. No.: 117,366

[22] Filed: Oct. 28, 1987

Related U.S. Application Data

[63] Continuation of Ser. No. 862,975, May 14, 1986, abandoned.

[51] Int. Cl.[4] ..... A63B 21/00

[52] U.S. Cl. ..... 272/134; 272/96

[58] Field of Search ..... 272/117, 118, 134, 96

[56] References Cited

U.S. PATENT DOCUMENTS

| | | | |
|---|---|---|---|
| 3,020,046 | 2/1962 | Hotas | 272/96 |
| 3,116,062 | 12/1963 | Zinkin | 272/134 X |
| 3,917,262 | 11/1975 | Salkeld | 272/134 X |
| 4,336,934 | 6/1982 | Hanagan et al. | 272/117 |
| 4,337,939 | 7/1982 | Hoyle et al. | 272/96 |
| 4,357,010 | 11/1982 | Telle | 272/117 |
| 4,452,447 | 6/1984 | Lepley et al. | 272/96 |
| 4,577,861 | 3/1986 | Bangerter et al. | 272/96 |
| 4,605,220 | 8/1986 | Troxel | 272/96 |

*Primary Examiner*—Richard J. Apley

*Assistant Examiner*—J. Welsh

[57] ABSTRACT

A calf exercising machine which utilizes a frame-journaled rotating foot-engaging assembly, which rotates about an axis which is approximately common with the axes of rotation of the operator's ankle joints, to apply resistive force to the balls of an operator's feet through circular paths about the axes of rotation of the operator's ankle joints. The machine fixes the positions of the operator's ankle joints, through the use of body-machine contact surfaces which apply constraining forces to the operator's body, which balance the components of force applied at the ball-of-the-foot-engaging force-transmitting contact surfaces, throughout the range of the exercise movement. A second rotating body, which contains provision for loading weight onto, is journaled to the machine's frame and is mechanically linked to the rotating foot-engaging assembly. Together, these two rotating bodies, the link joining them, and the frame of the machine form a 4-bar linkage, which acts in conjunction with the rotating weight arm, to vary the resistive force applied to the balls of the operator's feet, throughout the exercise movement.

5 Claims, 7 Drawing Sheets

CALF ISOLATING EXERCISE MACHINE

This is a continuation of application Ser. No. 862,975, filed May 14, 1986, now abandoned.

This invention relates to exercise equipment, in particular to an exercise machine which develops an operator's calf muscles, through applying variably resistive forces to the balls of the operator's feet, through circular paths about the operator's fixed ankle joints. cl

BACKGROUND AND OBJECTIVES OF THE INVENTION

Present day calf developing machines are all designed to exercise the calf muscles through applying force-couples to the feet, which tend to rotate the feet about the ankle axes in the direction of dorsal flexion. These force-couples are each composed of two equal and opposite forces, one being applied to the ankles, downward through the tibea bones of the lower legs, and the other being applied to the balls of the feet, upward through body-machine contact surfaces. The calf muscles are developed during the exercise, as they oppose these force-couples by rotating the feet in the direction of plantar flexion.

Assuming that the balls of the feet do not slide off of the body-machine contact surfaces which they are in contact with, the net forces applied at the balls of the feet, through these body-machine contact surfaces, must be parallel with the forces applied down through the tibea bones to the ankles. This means that when the balls of the feet are higher than the ankle axes, as at the beginning of the foot extension movement, there will be a component of force, acting parallel to the body-machine contact surfaces which contact the balls of the feet, which will tend to make the balls of the feet slip off of these surfaces (a fact which is easily demonstrable by someone trying to stand in this position on a roller). These forces are balanced by frictional forces, acting parallel to and in the opposite direction, at the same spot. These frictional forces cause both wear to the operator's shoes and to his feet, during the beginning of the exercise movement. When the balls of the feet are lower than the ankle axes, the toes will pivot about the balls of the feet, due to the fact that the much weaker flexors of the toes cannot generate enough force to raise up on the toes (also easily demonstrable). This causes the soles of the shoes to bend around the balls of the feet during the end of the exercise movement, which causes both shoe and foot wear during the end of the exercise movement. The only point during the exercise movement that these wearing factors are eliminated is when the lines between the ankle axes and the balls of the feet are perpendicular to the applied force-couples.

An exercise machine, in order to be most effective at developing a muscle group, should apply a resistive force which varies in accordance with the muscle group's ability to apply force throughout its range of contraction. Due to joint mechanics and physiological make-up of the calf muscles, more force can be applied at the beginning through the middle of the foot extension movement than can be applied toward the end of the movement, and the resistive force which the machine applies should vary in accordance. To the best of the applicant's knowledge, no present day calf exercising machines apply such a varying force.

In view of the fact that present day calf developing machines apply stresses to the balls of the operator's feet and to the flexor muscles of the toes, in addition to the desireable stress applied to the foot extending calf muscles, it is the object of this invention to introduce a calf exercising machine which will eliminate the undesireable stresses and wearing factors associated with present day calf developing machines.

In accordance with the lack of ability of present day calf developing machines to apply a resistive force to an operator's calf muscles, which varies in accordance with the strength-to-position force applying capabilities of the calf muscles, it is a further objective of this invention, to introduce a calf developing machine which, through the use of a simple 4-bar linkage, will apply a resistive force which varies in accordance with the normal strength-to-position capabilities of the average operator in the foot extension exercise movement.

SUMMARY OF THE INVENTION

The machine disclosed in this application has two configurations, both of which share the same features and operate on the same principle, differing only in the way that they constrain the operator's body while performing the exercise. The first configuration exercises the operator's calf muscles while the operator is in a seated position with his legs extended straight (which develops the calf muscles through the extended end of their range of contraction), and the second configuration excercises the operator's calf muscles while the operator is in a seated position with his legs bent approximately 90° at the knee joints (which develops the calf muscles through the contracted end of their range of contraction).

Both configurations of this machine consist of a stable frame which is provided with an integral seat portion, which supports the operator's body while performing the exercise. Journaled in this frame, on an axis which is both approximately common with the axes of rotation of the operator's ankle joints and parallel with the ground plane, is a rotating foot-engaging force-transmitting assembly. This rotating foot-engaging force-transmitting assembly contains a pair of body-machine force-transmitting contact surfaces, which engage the balls of the operator's feet, and serve the function of applying resistive force to the balls of the operator's feet through circular paths about the operator's ankle axes. Also attached to this rotating foot-engaging force-transmitting assembly are a pair of body-machine contact surfaces, which engage the backs of the operator's heels, which balance the components of force applied at the balls of the feet, which tend to make the ankles move in a rearward direction, relative to the lower legs, at the beginning of the exercise movement (as illustrated in FIG. 1A). Attached to the machine's frame are a pair of body-machine contact surfaces, which engage the operator's shins just above the ankle joints, and serve the function of applying constraining forces to the fronts of the operator's shins just above the ankle joints, which balance the components of force applied at the balls of the feet, which, tend to make the ankles move in a rearward direction, relative to the lower legs, at the end of the exercise movement (as illustrated in FIG. 1C). Adjustably attached to the machine's frame, are another pair of (or in the case of the straight leg configuration - a single) body-machine contact surface(s), which engage either the tops of the operator's bent knees (bent leg configuration) or the back of the operator's lower back/buttocks region (straight leg configuration), and serve the function of applying constraining forces, which balance the major components of force applied at the balls of the feet, which, tend to make the ankles move in an upward direction, relative to the lower legs, throughout the exercise movement (as illustrated in FIGS. 1A, B, & C). Working together, these body-machine contact surfaces fix the positions of the operator's lower legs and ankle joints, while the force-transmitting surfaces, attached to the rotating foot-engaging force-transmitting assembly, apply resistive force to the balls of the operator's feet through circular paths about his ankle joints. Through fixing the positions of the ankle joints and applying resistive force to the balls of the feet through circular paths about the ankle joints, this invention applies force-couples to the operator's feet which are always perpendicular to the lines between the balls of the operator's feet and his ankle joints, which fulfills the objective of eliminating the undesireable stresses and wearing factors associated with present day calf developing machines.

Journaled in the frame of this machine is a second rotating assembly, which contains provision for loading weights onto at a point offset from its axis of rotation. This "rotating weight arm" rotates about an axis which is both parallel with and offset by a specific distance from the axis of rotation of the rotating foot-engaging assembly. These two rotating assemblies are mechanically linked to each other, at axes which are both parallel with and offset by specific distances from their respective axes of rotation, by a rigid connecting link which has a specific length between its centers of connection. These two rotating assemblies, the link joining them, and the frame of the machine join together to form a 4-bar linkage, which acts in conjunction with the rotating weight arm, to vary the resistive force applied to the balls of the operator's feet, throughout the exercise movement. Through a simple kinematic analysis, the specific lengths and orientations of the moving parts which constitute the 4-bar linkage/rotating weight arm force-varying mechanism can be specified to apply a load, at the ball-of-the-foot-engaging contact surfaces, which varies in accordance with the normal strength-to-position force applying capabilities of the average operator in the foot extending exercise movement, thus fulfilling the second objective of the invention.

DESCRIPTION OF THE PREFERRED EMBODIMENTS

Figure 1A:
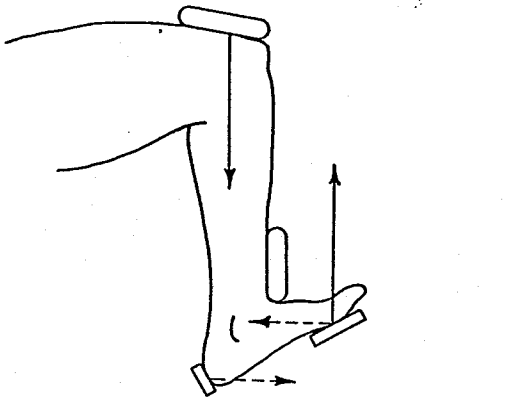
FIGS. 1A, B, and C are illustrations of the equilibrium of forces applied to the operators body by the body-machine contact surfaces in the respective beginning of the movement position (A), middle of the movement position (B), and end of the movement position (C).
Figure 1B:
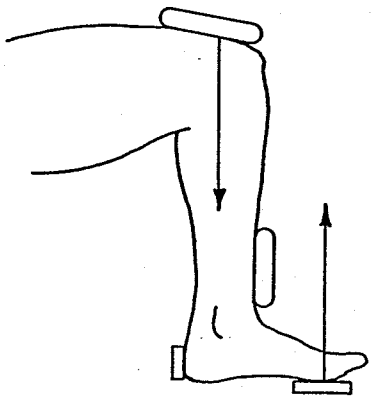
Figure 1C:
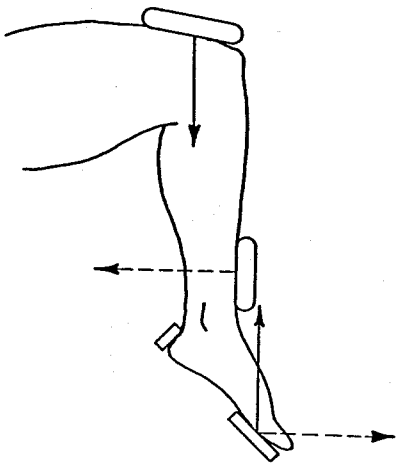
Figure 2B:
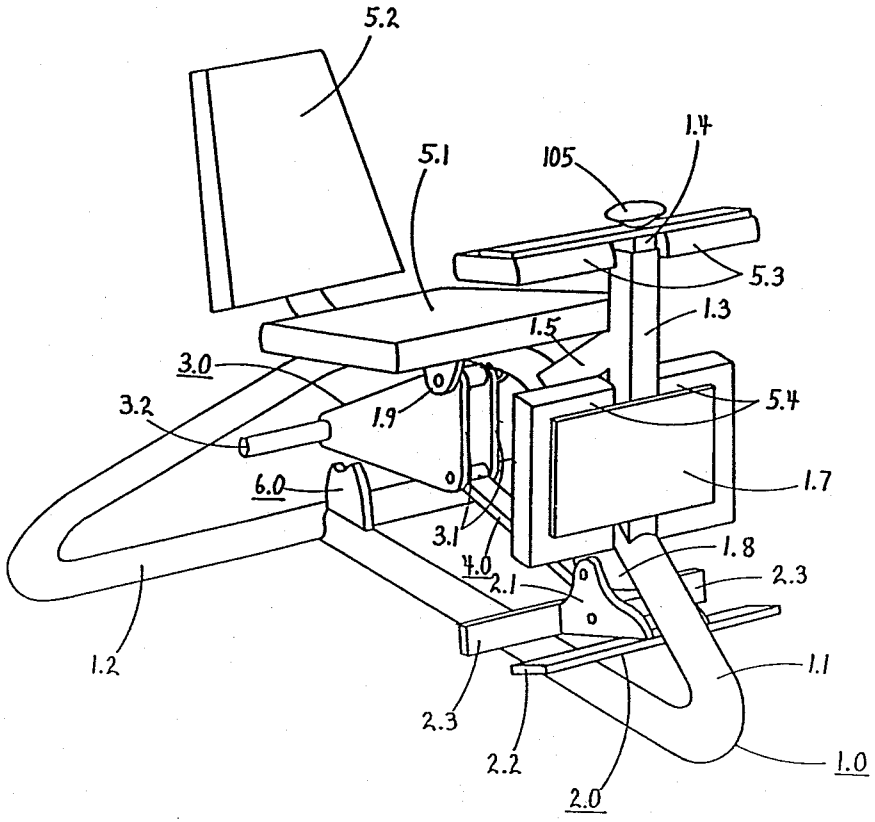
FIGS. 2A and B are pictorial views of the corresponding straight leg configuration of the machine (A), and bent leg configuration of the machine (B) with all visible parts labeled.
Figure 2A:
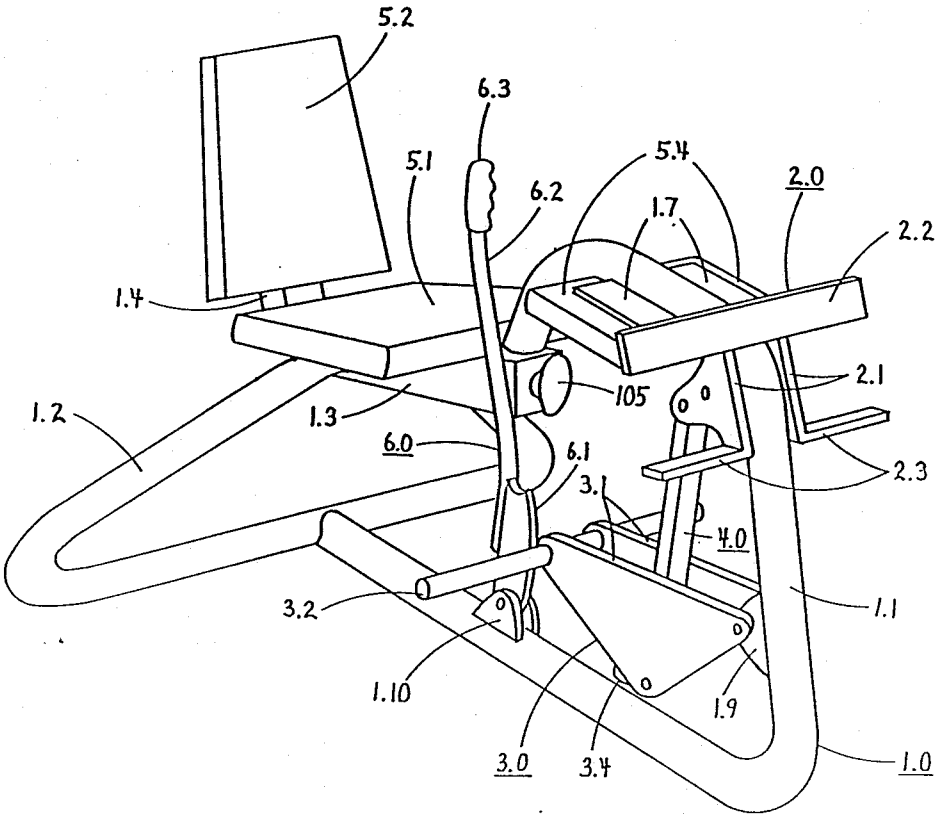

Refer now in detail to FIGS. 2A and B and 3A B which show corresponding pictorial and side views of the corresponding straight leg and bent leg configurations of the disclosed invention. In general, the frames of both configurations of the invention are constructed primarily of steel tubing which is welded together at the junctions where the tubes meet. Welded to these tubular steel frames are steel flanges for journaling the bearings for the moving parts and steel tabs for attaching padded body-machine contact surfaces. As can be seen in the figures, both configurations of this invention are simple, symmetrical, straightforward designs.

Figure 3A:
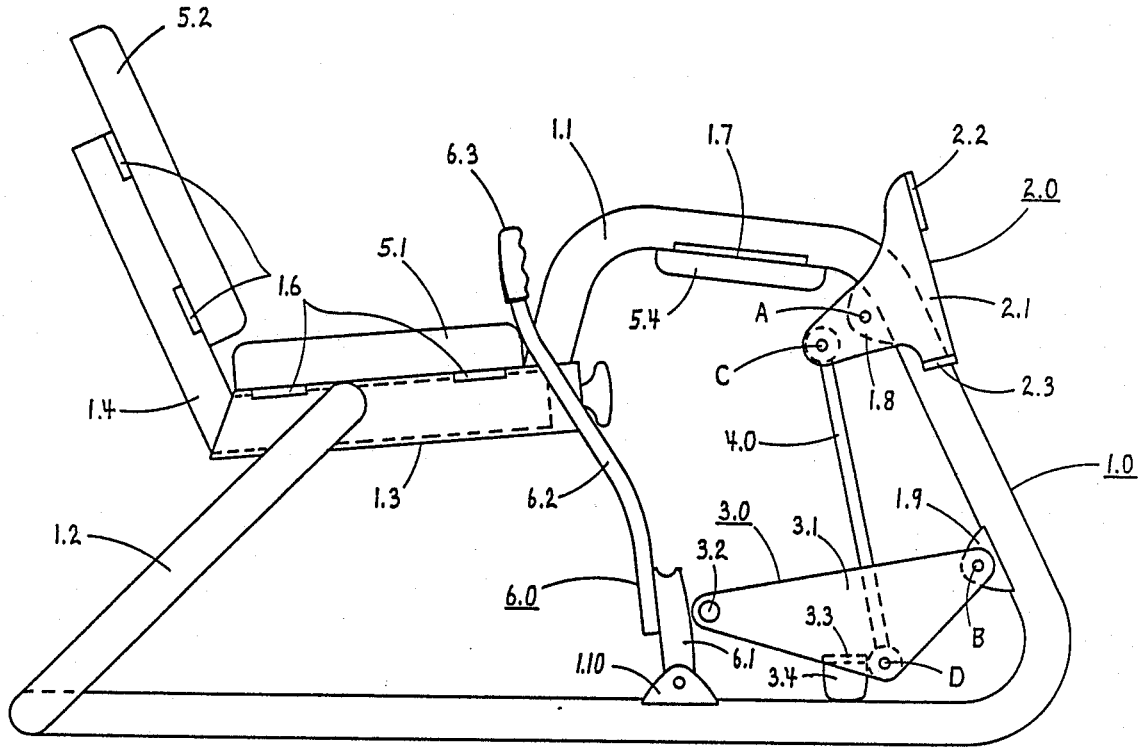
FIGS. 3A and B are side (plan) views of the corresponding straight leg configuration of the machine (A), and bent leg configuration of the machine (B) with all parts labeled.
Figure 3B:
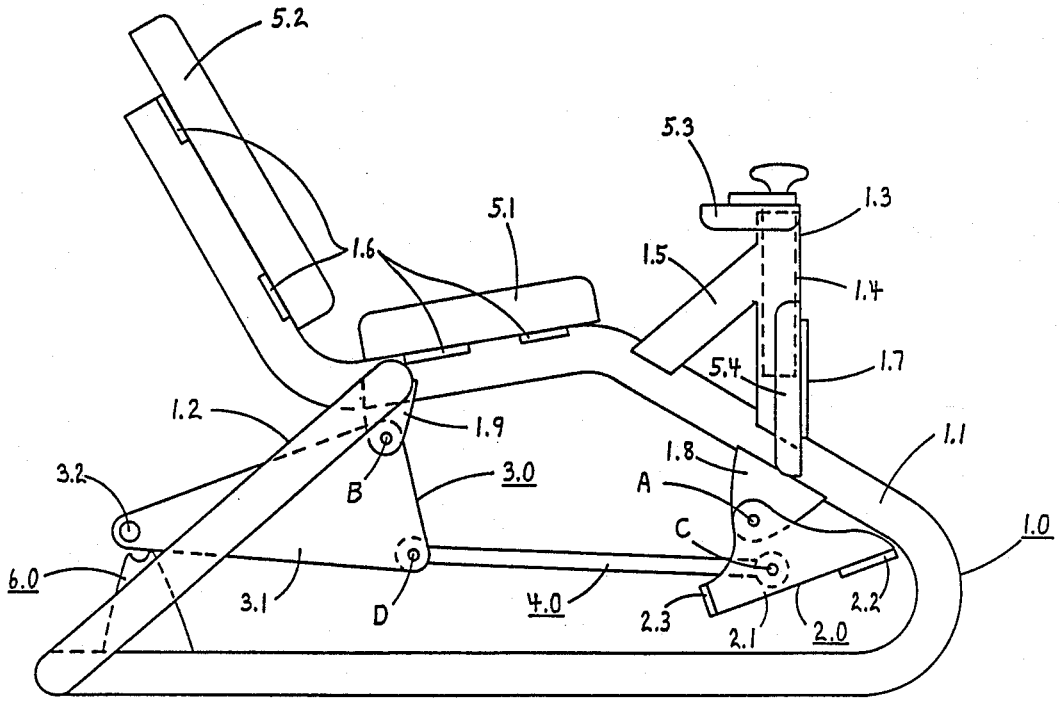

The primary frame of both configurations of this invention (assembly 1.0) consist of three round steel tubing loops. The first of these (1.1), which lies in the machine's plane of symmetry, differs in shape depending on the configuration, as shown in FIGS. 2 and 3. The other two (1.2), which lie in a plane which is both perpendicular to the machine's plane of symmetry and oriented at about a 45° angle to the ground plane, are symmetrical to each other about the machine's plane of symmetry and have the same shape in both configurations, as shown in FIGS. 2 and 3. These three loops are welded together to form a simple, stable frame for the respective configurations. In both configurations, these three loops join at their lower rearward ends in a "T" junction at the back of the machine on the ground plane. In the straight leg configuration (FIGS. 2A and 3A), these three loops join at their upper ends into a rectangular tube (1.3) which lies in the machine's plane of symmetry. The central loop (1.1) joins into the rectangular tube (1.3) on its top side just in front of the seat pad, as shown, and two side loops (1.2) join into the rectangular tube (1.3) on its sides just below the seat of the machine, as shown. In the bent leg configuration of the machine (FIGS. 2B and 3B), these three loops join into a "cross" junction at their upper ends just below the seat of the machine, where the two loops to the sides (1.2) butt into the central loop (1.1), which extends rearward past the junction and bends up into a back pad support, as shown.

In the straight leg configuration (FIGS. 2A and 3A), a seat support pad (5.1) is centered about the machine's plane of symmetry and mounted to frame-attached steel tabs (1.6) generally over the junction of the two side loops (1.2) and the rectangular tube (1.3). In the bent leg configuration (FIGS. 2B and 3B), the seat support pad (5.1) is centered about the machine's plane of symmetry and mounted to frame-attached steel tabs (1.6) generally over the junction of the two side loops (1.2) and the central loop (1.1).

In the straight leg configuration (FIGS. 2A and 3A), a back support pad (5.2) is centered about the machine's plane of symmetry and mounted to steel tabs (1.6), which are attached to the "upright" leg of a 70° "L"

shaped back support assembly (1.4), which is composed of two rectangular tubes joining at a 70° angle. The "base" leg of this "L" shaped back support assembly (1.4) telescopes inside of the stationary frame-mounted rectangular tube (1.3), as shown. In the bent leg configuration of the machine (FIGS. 2B and 3B), the back support pad (5.2) is centered about the machine's plane of symmetry and mounted in a fixed position to frame-attached steel tabs (1.6) on the generally upright portion at the top of the frame's central loop (1.1).

Figure 4B:
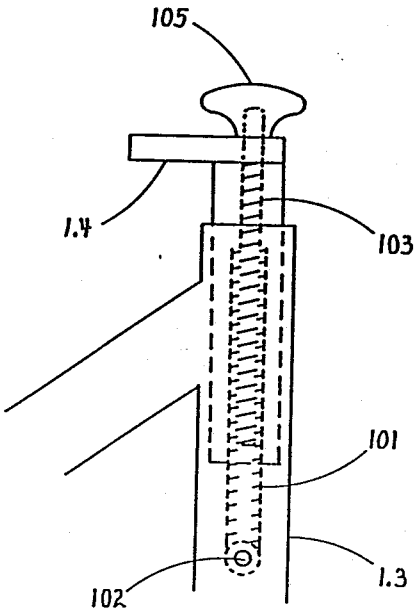
FIGS. 4A and B are detailed plan views of the adjusting mechanism used on the corresponding straight leg configuration of the machine (A), and bent leg configuration of the machine (B) with all parts labeled.
Figure 4A:
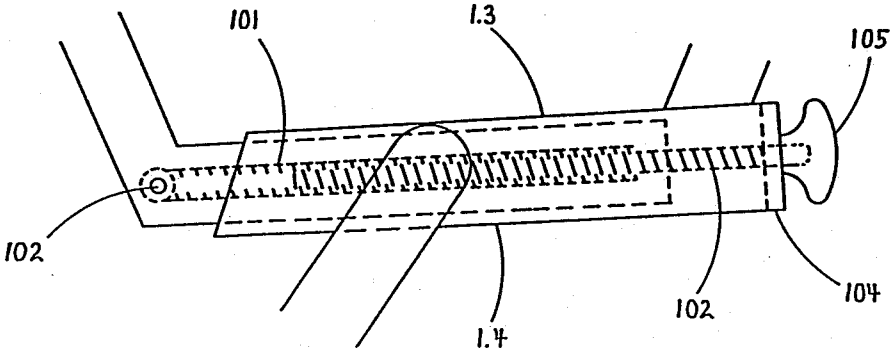

The back support assembly (1.4) used in the straight leg configuration of this machine is actuated to move back and forth along the axis of the engaging telescoping rectangular tubes (1.3 and 1.4) by an engaging pair of internal and external threads, as shown in detail in FIG. 4A. As shown in FIG. 4A, the rearward end of the internal thread (101) is axially and radially anchored to the "L" shaped back support assembly (1.4) at a position approximately where the legs meet by a transverse pin (102). The forward end of the internal thread (101) engages the rearward end of the external thread (103). The forward end of the external thread (103) is axially but not radially anchored to a steel plate (104) which s welded to the front of the external (frame-mounted) rectangular tube (1.3). Attached to the front of the external thread (103) is a hand-actuated knob (105) which is used in operating the adjusting mechanism.

The bent leg configuration of this machine (shown in FIGS. 2B and 3B) also contains a pair of telescoping rectangular tubes. The outer frame-mounted rectangular tube (1.3) lies vertically in the machine's plane of symmetry in a position generally directly above and extending radially away from the axis of rotation of the machine's foot-engaging force-transmitting assembly (axis A). This rectangular steel tube (1.3) joins, at its bottom end, into the upper forward end of the central loop of the machine (1.1). Also lying in the machine's plane of symmetry and extending diagonally rearward from the upper end of the vertical rectangular steel tube (1.3) down to the central loop (1.1) is a rectangular tube brace (1.5). Telescoping inside of the vertical rectangular tube (1.3) is a "T" shaped leg holddown assembly (1.4) which is composed of a vertical telescoping tube which joins into a transverse flat steel bar at its top end. Leg holddown pads (5.5) are attached to the underside of the transverse bar on this "T" shaped leg holddown assembly (1.4), one on each side, in positions where they will engage the operator's lower frontal thigh/knee regions while performing the exercise with legs in generally parallel planes.

The leg holddown assembly (1.4) used in the bent leg configuration of this machine (FIGS. 2B and 3B) is actuated to move up and down along the axis of the engaging telescoping rectangular tubes (1.3 and 1.4) by an engaging pair of internal and external threads, as shown in detail in FIG. 4B. As shown in FIG. 4B, the bottom end of the internal thread (101) is axially and radially anchored to the lower end of the external (frame-mounted) rectangular tube (1.3) by a transverse pin (102). The upper end of the internal thread (101) engages the lower end of the external thread (103). The upper end of the external thread (103) is axially but not radially anchored to the transverse flat steel bar at the top of the "T" shaped leg holddown assembly (1.4). Attached to the top of the external thread (103) is a hand-actuated knob (105) which is used in operating the adjusting mechanism.

As shown in FIGS. 2 and 3, both configurations of this machine contain stationary frame-mounted ankle constraining pads (5.4). In the straight leg configuration of the machine (FIGS. 2A and 3A), these pads (5.4) are attached to a steel bracket (1.7) which is welded to the central loop of the machine (1.1) in a position generally along the bottom side of its top forward flat section. As shown in FIG. 3A, these pads (5.4) are located, relative to the rotational axis of the foot-engaging force-transmitting assembly (axis A), in such a position that they will engage the front of the operator's shins just above the ankles (one on each side) when the operator is in the operating position with his ankles axes of rotation approximately common with the axis of rotation of the foot-engaging force-transmitting assembly (assembly 2.0). In the bent leg configuration of the machine (FIGS. 2B and 3B), these pads (5.4) are attached to a steel bracket (1.7) which is welded to the lower forward side of the frame-mounted stationary rectangular tube (1.3). As shown in FIG. 3B, these pads (5.4) are located, relative to the rotational axis of the foot-engaging force-transmitting assembly (axis A), in such a position that they will engage the front of the operator's shins just above the ankles (one on each side) when the operator is in the operating position with his ankles axes of rotation approximately common with the axis of rotation of the foot-engaging force-transmitting assembly (assembly 2.0).

As shown in FIGS. 2 and 3, both configurations of this machine contain a rotating foot-engaging force-transmitting assembly (assembly 2.0) which rotates about an axis (axis A) which is both common with the axes of rotation of the operator's ankles while in the operating position, and which is parallel with the ground plane. This rotating assembly is journaled in bearings which are journaled in frame-attached flanges (1.8) which are attached to the machine's central loop (1.1) in positions corresponding to approximately where the operator's ankles axes of rotation would be when seated with legs in approximately parallel planes and extended approximately straight (straight leg configuration), or with legs in approximately parallel planes and bent approximately 90 at the knee joints (bent leg configuration), as shown in FIGS. 3A and 3B respectively.

Figure 5B:
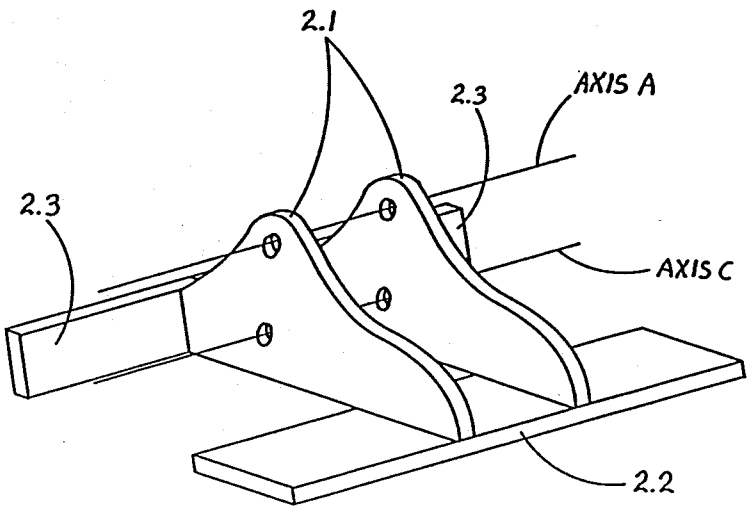
FIGS. 5A and B are detailed pictorial views of the rotating foot-engaging force-transmitting assembly on the corresponding straight leg configuration of the machine (A), and bent leg configuration of the machine (B) with all parts labeled.
Figure 5A:
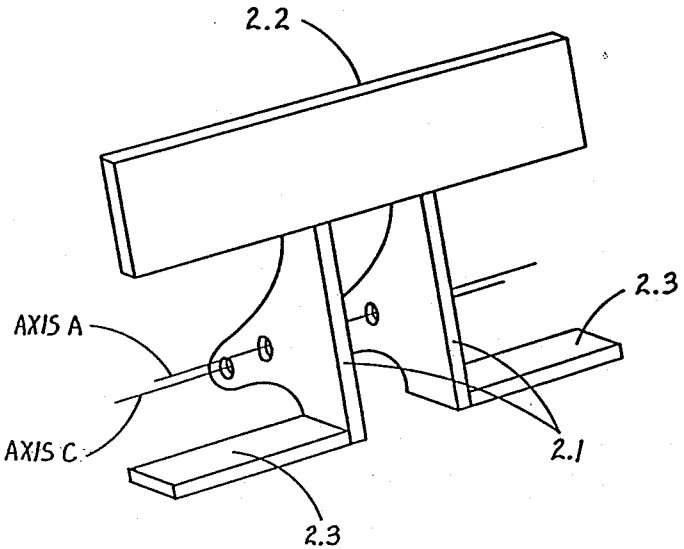

The foot-engaging force-transmitting assembly (assembly 2.0), in both configurations, is symmetrical about the machine's plane of symmetry which is perpendicular to its axis of rotation. It is composed of five rigid parts, as shown in detail in FIGS. 5A and 5B. The first two parts (2.1), one on each side of center, are flat steel plates which lie in parallel planes which are perpendicular to the assembly's axis of rotation, and positioned just to the outsides of the bearings which journal the assembly in the machine's frame. Perpendicular to these two parallel plates is a third relatively flat transverse steel bar (2.2) which is welded to these two parallel plates (2.1), giving the assembly its integrity. This transverse member (2.2) extends outward approximately 5" past each parallel plate (2.1) to each side of the assembly, and is placed, relative to the axis of rotation of the assembly (which corresponds with the axes of rotation of the operator's ankles), in such a position that it will engage the balls of the operator's feet (one on each side of the assembly), as shown. The last two members (2.3) of this rotating assembly (one on each side) are perpendicularly attached to the two parallel members (2.1). These members (2.3) each extend out approximately 5" from the outer surfaces of the parallel members (2.1)

and are placed, relative to the axis of rotation of the assembly (which corresponds with the axes of rotation of the operator's ankles), in positions where they will engage the backs of the operator's heels (one on each side of the assembly), as shown. This assembly (assembly 2.0) is mounted to its bearings by a steel pin which is centered on the assembly's axis of rotation (axis A) in two holes (one in each of the parallel plates - 2.1). Offset from these two holes (one in each plate) which lie on the assembly's axis of rotation are two more holes (one in each plate) which are centered on the same axis (axis C) which is both parallel with and offset from the assembly's axis of rotation (axis A) by a distance of 3.0", as shown in FIGS. 6A and 6B.

Figure 6A:
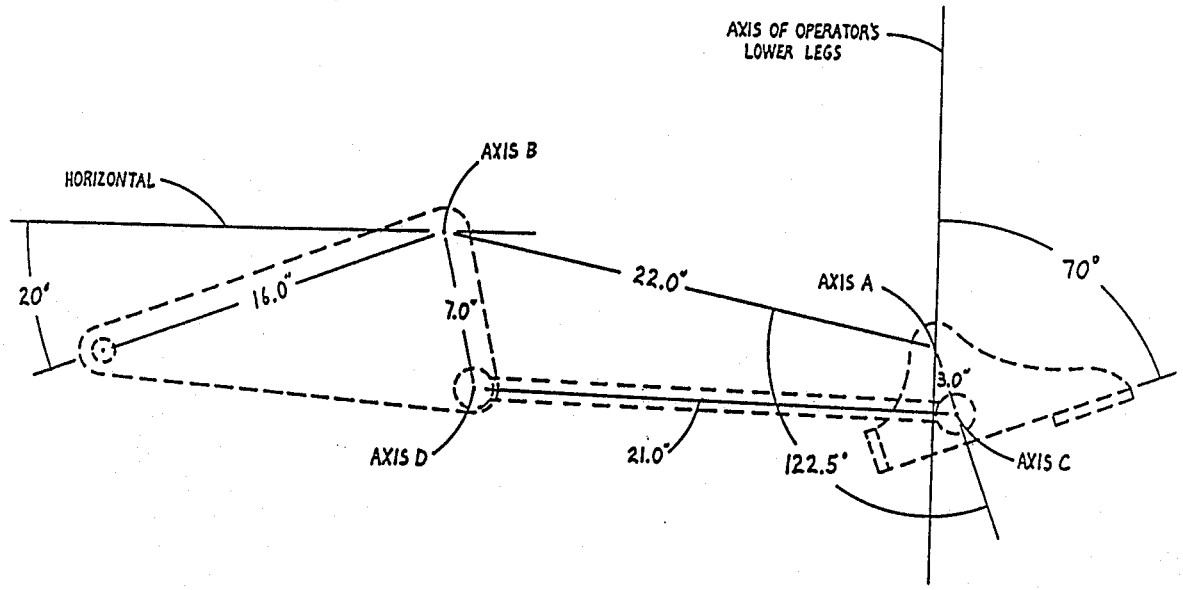
FIGS. 6A and B are corresponding plan views of the force-varying mechanism superimposed on the moving parts of the corresponding straight leg configuration of the machine (A), and bent leg configuration of the machine (B).
Figure 6B:
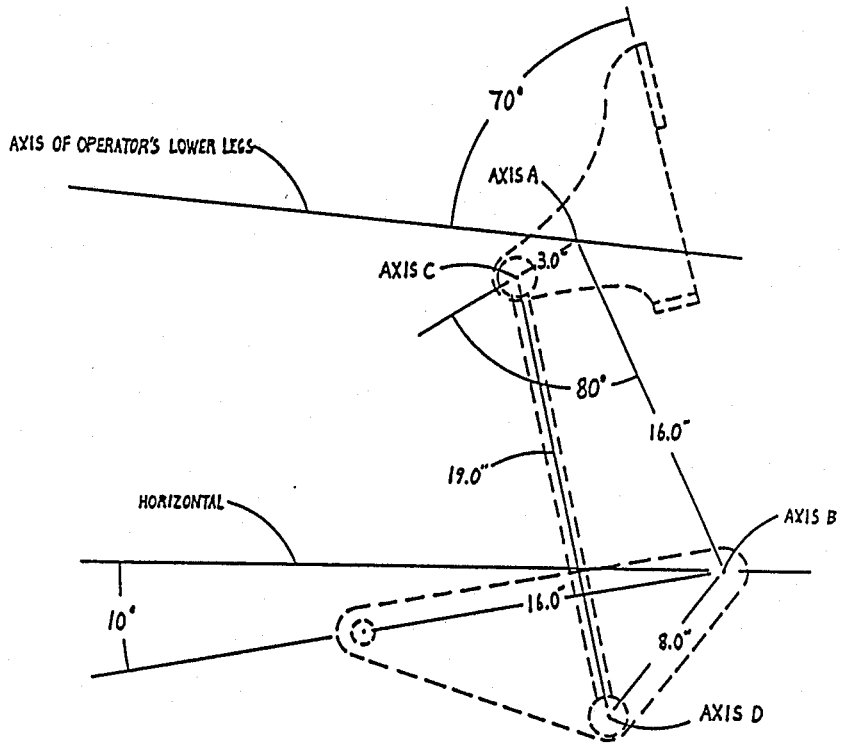
Figure 7B:
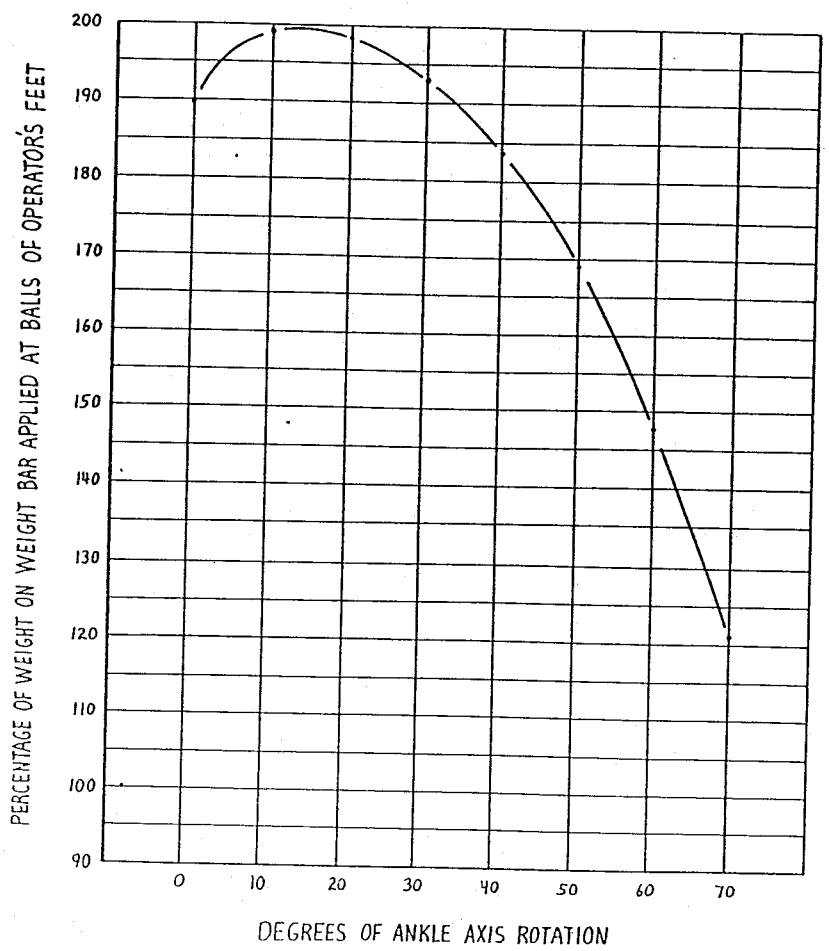
FIGS. 7A and B are graphs generated from kinematic analysis of the corresponding force-varying mechanisms shown in FIGS. 6A and B for the corresponding straight leg configuration of the machine (A), and bent leg configuration of the machine (B).
Figure 7A:
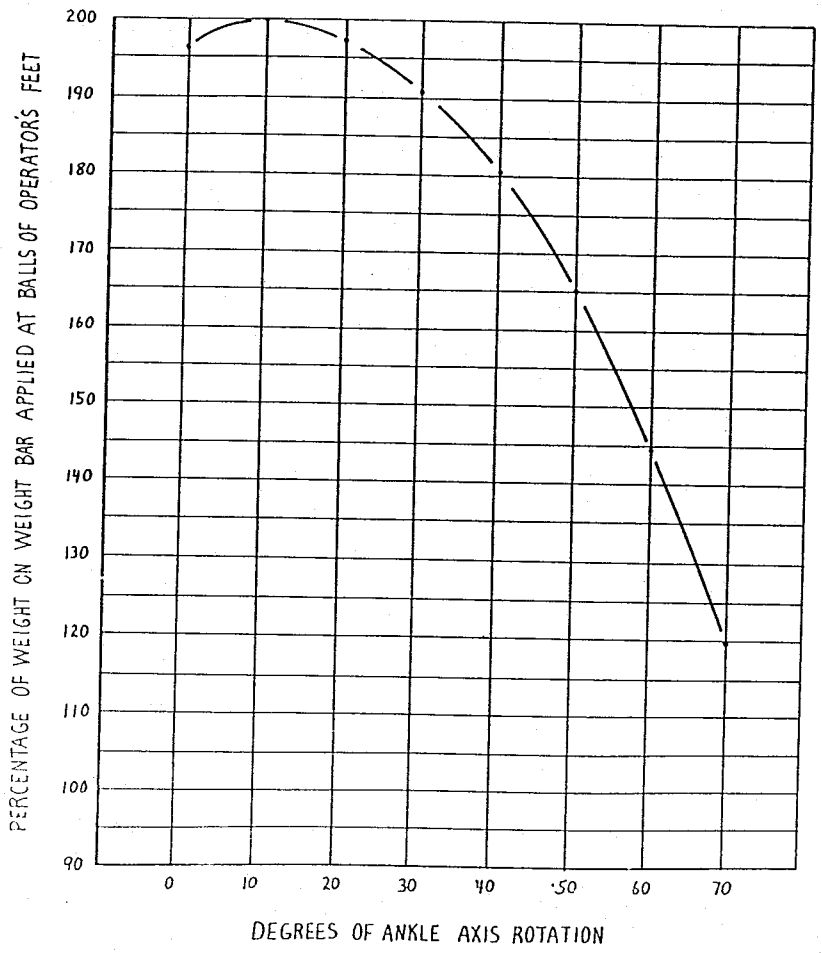

When the rotating foot-engaging force-transmitting assembly (assembly 2.0) is in its starting position (which corresponds to the point where the angle formed between the bottoms of the operator's feet and his tibea bones is 70°, as shown in FIGS. 6A and 6B), the angle formed between the line connecting axis A with axis C and the line connecting axis A with axis B must be 80° in the straight leg configuration, as shown in FIG. 6A, and 122.5° in the bent leg configuration, as shown in FIG. 6B, in order for the corresponding force-varying mechanisms to yield the corresponding outputs shown in the corresponding graphs for the straight leg configuration (FIG. 7A), and the bent leg configuration (FIG. 7B).

As shown in FIGS. 2 and 3, both configuration of this machine contain a rotating weight arm assembly (assembly 3.0) which rotates about an axis (axis B) which is parallel with the axis of rotation of the rotating foot-engaging force-transmitting assembly (axis A), separated from it by a specific distance, and placed so that the assembly and any weights mounted at its distal end will clear any obstructions throughout their range of motion.

In the straight leg configuration (FIGS. 2A and 3A), the rotating weight arm assembly (assembly 3.0) is journaled in bearings which are journaled in frame-attached flanges (1.9) which are welded to the back side of the lower forward portion of the frame's central loop (1.1). In this configuration, the distance between the rotational axes of these two rotating assemblies (assemblies 2.0 and 3.0) is 16.0", as shown in FIG. 6A. In the bent leg configuration (FIGS. 2B and 3B), the rotating weight arm assembly (assembly 3.0) is journaled in bearings which are journaled in frame-attached flanges (1.9) which are welded to the bottom sides of the two frame side loops (1.2) approximately at the "cross" junction where they butt into the central loop of the machine (1.1). In this configuration, the distance between the rotational axes of these two rotating assemblies (assemblies 2.0 and 3.0) is 22.0", as shown in FIG. 6B.

The rotating weight arm assembly (assembly 3.0), in both configurations, is symmetrical about the machine's plane of symmetry which is perpendicular to its axis of rotation. This rotating weight arm assembly (assembly 3.0), in both configurations, is primarily composed of two parallel triangularly shaped flat steel plates (3.1) which contain bearings for rotation of the assembly at one angle, bearings for connecting a connecting link between the two rotating assemblies at another angle, and a transversely mounted weight support bar (3.2) at the third angle, as shown in the side views (FIGS. 3A and 3B). The axis of rotation of the assembly (axis B), the axis for connecting the connecting link between the two assemblies (axis D), and the axis of the weight support bar are all parallel. The distance between the axis of rotation of the assembly (axis B) and the connecting link's axis of connection (axis D) is 8.0" in the straight leg configuration, as shown in FIG. 6A, and 7.0" in the bent leg configuration, as shown in FIG. 6B. The distance between the axis of rotation of the assembly (axis B) and the axis of the weight support bar (3.2) is 16.0", in both configurations, as shown in FIGS. 6A and 6B.

The two rotating assemblies on this machine (assemblies 2.0 and 3.0) are mechanically linked to each other by a rigid steel bar (4.0) which contains parallel bushings at its opposite ends. One end of this connecting link (4.0) connects, by way of a steel pin, to the rotating foot-engaging force-transmitting assembly (assembly 2.0) at axis C, as shown in FIGS. 3 and 6. The opposite end of this connecting link (4.0) connects, by way of another steel pin, to the rotating weight arm assembly (assembly 3.0) at axis D, as shown in FIGS. 3 and 6. The distance between the axes of the parallel bushings on this connecting link (4.0) is 19.0" in the straight leg configuration, as shown in FIG. 6A, and 21.0" in the bent leg configuration, as shown in FIG. 6B.

When the rotating foot-engaging force-transmitting assembly is in its starting position (which, as stated earlier, corresponds to the point where the angle formed between the bottoms of the operator's feet and his tibea bones is 70°), the angle formed between the line connecting the axis of rotation of the weight arm assembly with the axis of the weight bar and the horizontal must be approximately 10° below horizontal in the straight leg configuration, as shown in FIG. 6A, and approximately 20° below horizontal in the bent leg configuration, as shown in FIG. 6B, in order for the corresponding force-varying mechanisms to yield the corresponding outputs shown in the corresponding graphs for the straight leg configuration (FIG. 7A), and the bent leg configuration (FIG. 7B).

In the straight leg configuration of the machine, a bumper (3.4) is attached to a flat steel connecting piece (3.3) which is welded transversely between the two parallel plates (3.1) at the bottom of the rotating weight arm assembly (assembly 3.0) in a position just behind the bearings where the connecting link attaches, as shown in FIG. 3A.

In the straight leg configuration of the machine, a disengageable weight support assembly (assembly 6.0) is journaled in bearings which are journaled in frame-attached flanges (1.10) which are located generally below the position of the weight supporting bar (3.2). This weight support assembly (assembly 6.0) is composed of a weight support arm (6.1) which extends radially away from the assembly's axis of rotation. Integral to and sharing a common axis of rotation with this weight support arm is a hand lever (6.2) which extends generally upward when it ends in a hand grip (6.3) at its distal end which is located in a position just in front of the operator, as shown in FIGS. 2A and 3A. In the bent leg configuration of the machine, a stationary weight support bracket (6.0) is welded to the frame of the machine in a position generally below the weight support bar (3.2), as shown in FIGS. 2B and 3B.

HOW THE INVENTION WORKS

As is illustrated in FIG. 6A (straight leg configuration) and FIG. 6B (bent leg configuration) the rotating foot-engaging force-transmitting assembly (assembly 2.0), the rotating weight arm assembly (assembly 3.0), the connecting link (part 4.0), and the frame of the machine (assembly 1.0) join to form a 4-bar linkage. This 4-bar linkage, as described in FIG. 6A (straight leg configuration) or FIG. 6B (bent leg configuration), when working in conjunction with the sinusoidally changing values of force applied by the respective configuration's rotating weight arm as the weights swing through a circular path through the gravitational field, yields the variably resistive force shown in FIG. 7A (straight leg configuration) or FIG. 7B (bent leg configuration), which closely corresponds to the strength-to-position capabilities of the average operator in this body movement.

To use the machine, an operator would simply sit on the seat portion and position his feet in the rotating foot-engaging force-transmitting assembly (entering in from the sides where there is open access). He would then adjust the telescoping tube actuating hand knob (105) until the axis of rotation of his ankles were approximately common with the axis of rotation of the rotating foot-engaging force-transmitting assembly. If in the straight leg configuration of the machine, he would then pull back on the disengageable weight support hand grip (6.3) and lower the weights to the starting position (which, as stated earlier, corresponds to the point where the angle formed between the shins of the legs and the bottoms of the feet is 70). Once in the starting position, he would then begin the exercise by contracting his calf muscles which would extend his feet (plantar flexion). The muscle developing resistance to this movement would be variably applied to the balls of the operator's feet through circular paths about his ankles axes of rotation through body-machine contact with the transverse member of the foot-engaging force-transmitting assembly (2.2) which is mechanically linked to the weights loaded on the weight support bar (3.2) through the rigid members of the 4-bar linkage/-rotating weight arm force-varying mechanism.

CONCLUSION

Because the machine disclosed in this application applies resistive force to the balls of the feet through circular paths about the ankle axes, which is the same path which the balls of the feet move through in pure extension (plantar flexion) of the feet, relative motion between the balls of the feet and the body-machine contact surfaces which they come in contact with is eliminated. This, in turn, results in reduced wear to the balls of the feet and shoes, and increased isolation of the foot extending calf muscles.

This machine applies a resistive force to the balls of the feet which both varies as a function of ankle axes rotation and is correlated to the normal strength-to-position capabilities of an average operator's foot-extending calf muscles. This variably resistive force is obtained through the use of a 4-bar linkage acting in conjunction with a rotating weight arm. This force-varying mechanism consist of only three moving parts connected to each other and to the frame of the machine at a total of only four pivotal joints, making the machine inherently more reliable, less noisy, and more friction free than a machine utilizing cams, chains, or cables.

I claim:

1. A calf exercising machine, comprising:

a rigid frame which includes means for supporting an operator in a seated position of operation;

a rigid rotating foot-engaging assembly which is journaled in said frame an axis which is approximately common with the axes of rotation of said operator's ankle joints while said operator is supported in said machine's frame in the operating position;

said rigid rotating foot-engaging assembly includes ball-of-the-foot-engaging surfaces which, through body-machine contact, apply resistive force to the balls of the operator's feet through circular exercise movement paths about the rotational axes of the operator's ankle joints;

said rigid frame includes means for fixing the positions of both the operator's lower legs and ankle joints while performing the exercise movement, as by means of providing body-machine contact surfaces which apply constraining forces to the operator's body which balance the forces acting at the ball-of-the-foot-engaging surfaces which would tend to displace the operator's ankle joints and/or lower legs relative to the axis of rotation of said rigid rotating foot-engaging assembly;

a rigid rotating weight arm which is journaled in said machine's frame on an axis which is both parallel with and separated by a specific distance from the axis of rotation of said rigid rotating foot-engaging assembly;

said rigid rotating weight arm includes means for loading weights onto at a point offset from its axis of rotation;

said rigid rotating foot-engaging assembly and said rigid rotating weight arm are mechanically linked to each other, at axes which are both parallel with and offset by specific distances from their respective axes of rotation, by a rigid connecting link which has a specific length between its centers of connection;

said rigid rotating foot-engaging assembly, said rigid rotating weight arm, said link mechanically joining said rigid rotating foot-engaging assembly and said rigid rotating weight arm, and said frame of said calf exercising machine join together to form a four-bar linkage which, when acting in conjunction with the sinusoidally changing values of force applied by the machine's rotating weight arm as the weights swing through a circular path through the gravitational field, applies a predetermined variably resistive force at the ball-of-the-foot-engaging surfaces on said rigid rotating foot-engaging assembly, which varies as a function of the degrees of rotation of the operator's ankle joints and which is characteristic of the relationships in length and orientation of the four rigid members forming the four-bar linkage and the orientation of the rotating weight arm to the gravitational field throughout the range of the exercise movement;

said specific distance between the axis of rotation of said rigid rotating foot-engaging assembly and the axis of rotation of said rigid rotating weight arm, said specific distance between the axis of rotation of said rigid rotating foot-engaging assembly and the axis of connection of said connecting link on said rigid rotating foot-engaging assembly, said specific distance between the axis of rotation of said rigid rotating weight arm and the axis of connection of said connecting link on said rigid rotating weight arm, and said specific distance between the centers of connection on said connecting link all have a definite non-changing relationship to each other, which relationship, along with their orientations to each other, is determined through kinematic analysis of the moving parts of the four-bar linkage/rotating weight arm force-varying mechanism and is dependent on said predetermined variably resistive force which said four-bar linkage/rotating weight arm force-varying mechanism is designed to put out throughout the exercise movement.

2. The calf exercising machine of claim 1, in which the means for fixing the positions of the operator's lower legs and ankle joints comprises:

anterior movement fixing means having frame-attached body-machine contact surfaces which engage the fronts of the operator's shins just above the ankle joints;

posterior movement fixing means having back-of-the-heel-engaging surfaces which are attached to said rigid rotating foot-engaging assembly;

superior movement fixing means having a frame-attached body-machine contact surface which engages the operator's lower back/buttocks region while said operator is in a seated position with his legs extended approximately straight.

3. The calf exercising machine of claim 1, in which the means for fixing the positions of the operator's lower legs and ankle joints comprises:

anterior movement fixing means having frame-attached body-machine contact surfaces which engage the fronts of the operator's shins just above the ankle joints;

posterior movement fixing means having back-of-the-heel-engaging surfaces which are attached to said rigid rotating foot-engaging assembly;

superior movement fixing means having frame-attached body-machine contact surfaces which engage the operator's lower thigh/knee regions, just above the knee joints, while said operator is in a seated position with his legs bent approximately 90° at the knee joints.

4. The calf exercising machine of claim 2, wherein the lower back/buttocks engaging contact surface is infinitely adjustable in order to adjust the distance between the axis of rotation of said rigid rotating foot-engaging assembly and the lower back/buttocks engaging contact surface through the use of an adjustable engaging pair of internal and external threads which actuate a frame-mounted telescoping assembly to which the lower back/buttocks engaging contact surface is attached.

5. The calf exercising machine of claim 3, wherein the lower thigh/knee engaging contact surfaces are infinitely adjustable in order to adjust the distance between the axis of rotation of said rigid rotating foot-engaging assembly and the lower thigh/knee engaging contact surfaces through the use of an adjustable engaging pair of internal and external threads which actuate a frame-mounted telescoping assembly to which the lower thigh/knee engaging contact surfaces are attached.

* * * * *